US005711792A

United States Patent [19]

Miller

[11] Patent Number: 5,711,792

[45] Date of Patent: Jan. 27, 1998

[54] FOUNDRY BINDER

[75] Inventor: Nigel David Miller, Cheshire, England

[73] Assignee: Borden Chemical UK Limited, Southampton, England

[21] Appl. No.: 647,923

[22] PCT Filed: Nov. 30, 1994

[86] PCT No.: PCT/GB94/02626

§ 371 Date: Sep. 9, 1996

§ 102(e) Date: Sep. 9, 1996

[87] PCT Pub. No.: WO95/15230

PCT Pub. Date: Jun. 8, 1995

[30] Foreign Application Priority Data

Nov. 30, 1993 [GB] United Kingdom ..... 9324509

[51] Int. Cl.[6] ..... B22C 1/18

[52] U.S. Cl. ..... 106/38.22; 106/38.2; 264/219; 264/319; 264/225

[58] Field of Search ..... 106/38.2, 38.22, 106/38.35, 691; 501/17; 264/219, 319, 220, 222, 225, 226

[56] References Cited

U.S. PATENT DOCUMENTS 4,541,869 9/1985 Maak et al. ..... 106/38.35

FOREIGN PATENT DOCUMENTS 2856267 7/1980 Germany .
1678497 9/1991 U.S.S.R. .
9206808 4/1992 WIPO .

*Primary Examiner*—Michael Marcheschi
*Attorney, Agent, or Firm*—Watson Cole Stevens Davis, PLLC

[57] ABSTRACT

A binder composition for binding a water-insoluble particulate material, such as sand, in the manufacture of a foundry mold or core comprises a mixture of (1) an inorganic binder consisting of an aqueous solution containing polyphosphate chains and/or borate ions and (2) a water-soluble surfactant. The inclusion of a water-soluble surfactant improves the flowability of foundry molding compositions.

29 Claims, 1 Drawing Sheet

FOUNDRY BINDER

CROSS-REFERENCE TO RELATED APPLICATIONS

This is a 35 USC §371 application of international application No. PCT/GB94/02626, filed Nov. 30, 1994.

The present invention relates to a foundry binder, a water-dispersible core or mould prepared using the foundry binder and a process for making such a water-dispersible core or mould. More particularly, it relates to a foundry binder which when mixed with a water-insoluble particulate material gives a mixture having improved flowability.

Water-dispersible cores or moulds for use in making foundry castings or injection mouldings are known. In this respect, reference is made to published International application No WO 92/06808. Such water-dispersible cores or moulds are made according to a process comprising combining a water-insoluble particulate material such as sand with a binder which includes polyphosphate chains and/or borate ions, the chains and/or ions being dissolved in water and then forming the resulting mixture into a desired shape before removing the free water from the mixture. Typically, the binder is added to sand in the form of an aqueous solution of an inorganic glass, such as alkali metal polyphosphate or borate.

One of the main advantages of cores and moulds made using such inorganic binders compared to those made from traditional organic resin binders derives from the water-solubility of these inorganic binders. This feature provides the option to the foundryman of separating metal castings from cores and/or moulds made using such binders either by conventional shake-out methods or by dispersing the core or mould using water to dissolve the binder.

Three key measurable properties of systems containing such inorganic binders are:

a) the tensile strength of blown dog bones made from binder/sand mixes after purging with hot air and then cooled to room temperature, (referred to as P/O).

b) the dispersibility of cores after a heat treatment which simulates the casting operation.

c) the flowability of the binder/sand mix during core or mould making.

The flowability of a binder/sand mix is a very important characteristic. This is especially the case when a binder/sand mix is intended to be blown to form a core or mould. Good flow will generally lead to cores and moulds which are well compacted when blown, which in turn maximises their strength and reduces their surface friability.

A binder/sand mix having good flowability characteristics is able, for example, to fill core boxes with complicated geometries and fill simple shapes more efficiently at a fast production rate. Mixes with good flow vacate the blowing head effectively. This helps to prevent the problem of "rat-holing" in the blowing head, where the high pressure air used in blowing drives a channel through a mix with poor flow rather than propelling a flowable mass of sand into the core box.

Sand mix flowability is, therefore, a key factor in determining both the production rates and quality of cores and is a property which should be quantified and improved wherever possible.

It is known to add flow promoters to sand mixes with traditional organic resin binders. For instance, U.S. Pat. No. 5,077,323 teaches the addition of flow promoters in the form of fatty acids and derivatives to organic binder/sand mixes.

According to U.S. Pat. No. 4,996,249 the flowability of resin coated sand is improved by the addition of a fluorosurfactant to the sand/resin mixture.

The present invention provides a binder composition for binding a water-insoluble particulate material in the manufacture of a foundry mould or core which comprises a mixture of (1) an inorganic binder consisting of an aqueous solution containing polyphosphate chains and/or borate ions and (2) a water-soluble surfactant. The invention also provides a water dispersible core or mould for making a casting, the core or mould comprising a water-insoluble particulate material, a binder therefore and a water-soluble surfactant, the binder including polyphosphate chains and/or borate ions, the chains and/or ions being dissolved in water. The invention further provides a process for making a water dispersible core or mould for making a casting which process includes the steps of (a) providing a water-insoluble particulate material; (b) combining the particulate material with a binder including polyphosphate chains and/or borate ions, the chains and/or ions being dissolved in water and a water-soluble surfactant; (c) forming the particulate material and binder mixture into a desired shape; and (d) removing free water from the mixture.

We have found that the incorporation of a water-soluble surfactant into the binder/sand mixture enhances the flowability of the mixture. In addition, cores made with such mixes have good tensile strength and retain their water dispersibility, even after exposure to a simulated casting heat treatment.

In the present invention the binder includes polyphosphate chains and/or borate ions, and preferably these are respectively derived from at least one water soluble phosphate and/or borate glass. The binder and the water-soluble surfactant may be added together in the form of an aqueous solution to the particulate material or they may be added separately. Alternatively, the binder, the surfactant and the particulate material may be mixed together and then water may be added to the mixture.

DESCRIPTION OF THE PREFERRED EMBODIMENTS

Figure 1:
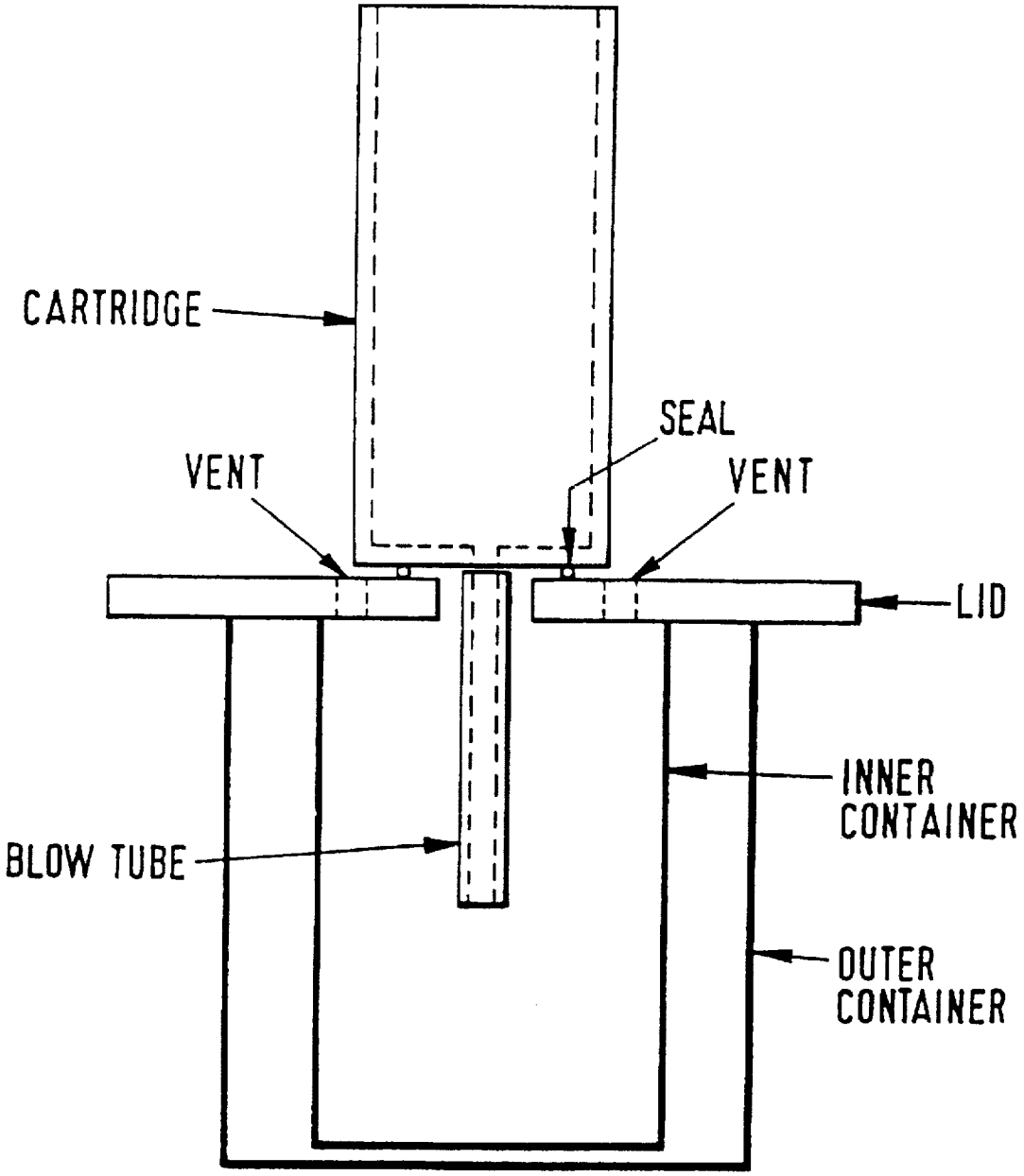
FIG. 1 is a schematic illustration of a blowability test apparatus.

In one preferred embodiment the binder is mixed with the particulate material in the form of an aqueous solution of at least one water soluble glass.

In another preferred embodiment, the binder that is mixed with the particulate material is added thereto in the form of particles of at least one water soluble glass. The polyphosphate chains and/or borate ions are then formed by mixing water with the mixture of particulate material and glass particles. The glass particles become wholly or partially dissolved into the water thereby to form the polyphosphate chains and/or borate ions.

The water-soluble glass may be wholly vitreous or partially devitrified, in the latter case the water-soluble glass having been heated and cooled thereby to form crystalline regions in an amorphous or glassy phase.

Without wishing to be bound by theory, it is believed that the polyphosphate chains are formed following the dissolution of the respective water soluble glasses into aqueous solution. These chains form an interlinking matrix throughout the core or mould, which is enhanced by hydrogen bonding of the chains by chemically bonded water molecules. After removal of excess water, the resulting dried core or mould retains the polyphosphate matrix which firmly binds together the water-insoluble particulate material. If excess water were not removed, the resulting wet mixture could be structurally weakened by the presence of water and would generally not be usable as a mould or core. In addition, the excess water would generate steam during the casting process which, as is well known in the art, would degrade the quality of the resultant casting.

Generally the principal component in a core or mould is a water insoluble particulate material which may be a refractory such as foundry sand, silica, olivine, chromite or zircon sand or another water insoluble particulate refractory material such as alumina, an alumino silicate or fused silica. The silica sands used for foundry work typically contain 98% by weight $SiO_2$. The core or mould may also contain minor amounts of other additives designed to improve the performance of the core or mould.

Preferably the binder comprises at least 0.25% by weight, and the particulate material comprises up to 99.75% by weight, of the total weight of the mixture of particulate material and the binder. More preferably the binder comprises from 0.5 to 50% by weight and the particulate material comprises from 99.5 to 50% by weight, of the total weight of the particulate material and the binder. Yet more preferably the binder comprises from 0.5 to 10% by weight and the particulate material from 99.5 to 90% by weight, of the total weight of the particulate material and the binder.

Preferably, the water soluble phosphate glass comprises from 30 to 80 mol % $P_2O_5$, from 20 to 70 mol % $X_2O$, from 0 to 30 mol % MO and from 0 to 15 mol % $L_2O_3$, where X is Na, K or Li, M is Ca, Mg or Zn and L is Al, Fe or B. More preferably, the water soluble phosphate glass comprises from 58 to 72 wt % $P_2O_5$, from 42 to 28 wt % $Na_2O$ and from 0 to 16 wt % CaO.

Such glasses include glasses of the following compositions in weight %:

| | 1 | 2 | 3 | 4 | 5 | 6 |
|---|---|---|---|---|---|---|
| $P_2O_5$ | 70.2 | 67.4 | 64.6 | 61.8 | 59.0 | 60.5 |
| $Na_2O$ | 29.8 | 28.6 | 27.4 | 26.2 | 25.0 | 39.5 |
| CaO | — | 4 | 8 | 12 | 16 | 0 |

As soluble glass, it is preferred to use a glass which has a solution or solubility rate of 0.1–1000 mg/cm$^2$/hr at 25° C. The glass preferably has a saturation solubility at 25° C. of at least 200 g/l, more preferably 800 g/l or greater, for phosphate glasses, and of at least 50 g/l for borate glasses.

The commonly available phosphate glasses are those from the binary system $Na_2O.P_2O_5$. The selection of glasses containing $K_2O$ or mixed alkali metal oxides can be made on the same basis but glasses containing $K_2O$ and/or mixtures of alkali metal oxides are less likely to be satisfactory as they are more prone to devitrification, and are also likely to be more costly.

A preferred glass is a phosphate glass from the binary system $Na_2O:P_2O_5$, with a molar ratio in the vicinity of $5Na_2O$ to $3P_2O_5$. Although such glasses can vary slightly in composition, we have satisfactorily used a glass containing $P_2O_5$ 60.5 weight %, $Na_2O$ 39.5 weight %. Such a glass has phosphate chains with an average value of n=4.11, n being the number of phosphate groups in the chain. Glasses with longer chain lengths such as n=30 when used as a binder give cores or moulds with a satisfactory strength to withstand the conditions encountered in both handling the core or mould and using it for casting but can produce a core or mould which after use in certain casting processes such as die casting of aluminium requires relatively longer treatment with water to achieve disintegration and removal. Typically a core or mould made with a glass with a chain length of about 30 requires about 10 minutes soaking in water and 30 seconds flushing with water for removal, compared to less than 1 minutes soaking in water and 30 seconds flushing for a glass with a chain length of about 4. Thus where quick removal is required the shorter chain length glass is preferred.

We have carried out a variety of studies in order to assess the suitability of various water-soluble sodium polyphosphate glasses for use as binders. The following table shows compositions of some of the glasses tested:

| Glass Sample Number | Wt % $P_2O_5$ | Wt % $Na_2O$ | Water |
|---|---|---|---|
| 1 | 69.0 | 30.5 | Balance |
| 2 | 67.0 | 32.5 | Balance |
| 3 | 65.0 | 34.5 | Balance |
| 4 | 63.0 | 36.5 | Balance |
| 5 | 60.5 | 39.0 | Balance |
| 6 | 58.0 | 41.5 | Balance |

We have noted that as the $Na_2O$ content of the sodium polyphosphate glasses increases, the phosphate chain length generally becomes shorter and this in turn tends to increase the tensile strength of the core formed with the phosphate binder. We believe, without being bound by theory, that shorter phosphate chains may be better able to utilise hydrogen bonding and that the more chain end phosphate groups present may give stronger hydrogen bonding. We have also found with sodium polyphosphate glasses that as $Na_2O$ content increases the dispersibility of a core employing such glasses as a binder tends to increase. We believe that this may indicate that the ability of partially hydrated glass to fully rehydrate and dissolve into solution is affected by small changes in composition.

In addition, we have found that as the $Na_2O$ content increases, the viscosity of the solution of the sodium polyphosphate glass in water also tends to increase. We believe that this tendency for an increase of viscosity may possibly indicate the tendency to have hydrogen bonding in aqueous solution. This in turn may possibly indicate that viscosity may indicate the suitability of a given sodium polyphosphate glass to be effective as a binder to give good solubility and tensile strength. As specified hereinbefore, the glass must have a sufficiently high saturation solubility and solubility rate to enable it quickly and sufficiently to go into aqueous solution. We have found that all the glasses specified in the above Table have sufficient solubility rates and saturation solubility values. We have also found that an important practical aspect of the choice of polyphosphate glasses for forming cores is related to the shelf life which the core will be required to be subjected to in use. We have found that as the $Na_2O$ content of the sodium polyphosphate glass increases, the tendency for the resultant core to be at least partially rehydrated by atmospheric moisture can increase, this leading to a consequential reduction in the tensile strength of the core thereby reducing the effective shelf life of the core. If the tensile strength is reduced in this manner the core may break prior to the casting process or may degrade during casting. Furthermore, we have found that the suitability of the various sodium polyphosphate glasses in any given casting process can depend on the temperature to which the resultant core is subjected during the casting process. We believe that this is because the temperature of the casting process can affect the binder in the core having consequential implications for the dispersibility of the core. For the use of a sand core during aluminium gravity die casting, the centre of a core may be subjected to temperatures of around 400° C. but the skin of the core may reach temperatures as high as 500° C. The dispersibility of cores generally decreases with increasing temperature to which the cores have been subjected. In addition, the variation of dispersibility with composition may vary at different temperatures. We believe that indispersibility of the core after the casting process may be related to the removal of all combined water in the core which was previously bound with the sodium polyphosphate binder. In order to assess water loss of various sodium polyphosphate binders we carried out a thermogravimetric analysis on hydrated glasses. A thermogravimetric analysis provides a relationship between weight loss and temperature. Thermogravimetric analyses were carried out on a number of sodium polyphosphate glasses and it was found that in some cases after a particular temperature had been reached there was substantially no further weight loss which appeared to suggest that at that temperature all combined water had been lost from the glass. We have found that if this temperature is lower than the temperature to which the core is to be subjected during a casting process, this indicates that the core may have poor post-casting dispersibility resulting from excessive water removal from the core during the casting process. A suitable core binder also required a number of other features in order to be able to produce a satisfactory core, such as dimensional stability, absence of distortion during the casting process, low gas evolution and low surface erosion in a molten metal flow.

Overall, it will be seen that there are a variety of factors which affect the choice and suitability of a binder. For any given application, the choice of a binder can be empirically determined by a trial and error technique. However, the foregoing comments give a general indication as to the factors affecting the properties of the binder. What is surprising is that from the combination of these factors, an inorganic binding material, such as a polyphosphate, can be subjected to the temperatures involved in a casting process and still remain readily soluble so as to enable a sand core which is held together by a binder of the polyphosphate material rapidly to be dispersed in water after the high temperature casting process.

As described above, the flowability of the mixture of binder, water and water-insoluble particulate material is improved by incorporating, into the mixture, a water-soluble surfactant. Preferably, the water-soluble surfactant will be an anionic type since we have found that anionic surfactants give a good compromise in terms of increased flowability, core strength and core dispersibility. However, other types of water soluble surfactants, such as nonionic, cationic and amphoteric surfactants, are also useful in the present invention. Of the anionic surfactants examined organic sulphates, sulphonates and phosphates are preferred. Generally, these compounds will contain a hydrophobic hydrocarbon group containing from 6 to 20 carbon atoms. Examples of surfactants that may be used in the present invention include alkyl sulphates, ether sulphates, alkyl sulphonates, aryl sulphonates, alkylaryl sulphonates, mono- and di-esters of orthophosphoric acid, mixtures thereof and salts thereof (where the hydrophobic group is derived from alcohols, alkylphenols and ethoxylated derivatives of these) alcohol ethoxylates and/or propoxylates, taurates, sarcosinates, ethoxylated sorbitan esters, amines, tetraalkylammonium salts and betaines.

Specific water-soluble surfactants which may be useful in the present invention include sodium dodecylbenzene sulphonate, sodium lauryl sulphate, sodium toluene sulphate, sodium 2-ethylhexyl sulphate, sodium lauryl ether sulphate, sodium alkylphenol ether sulphate, phosphated 2-ethylhexanol, including mixtures of mono- and di-esters and alkali metal salts thereof and ethoxylated alkylphenol phosphate esters, perfluoro alkyl sulphate, fatty acid sulphosuccinates, sodium-N-methyl-N-cocoyl taurate, oleoyl sarcosinate (acid form), dodecylamine, dicocoamine, dicocodimethyl ammonium chloride, ethylene oxide/propylene oxide OH 27-24, 11.8-7.8 and 25.4-21.5, polyoxyethylene sorbitan monooleate, polyoxyethylene sorbitan monolaurate, lauric acid diethanolamide (2:1), dodecyl/tetradecyl betaine mixture and coconut imidazoline betaine. These surfactants may work in this invention to varying degrees of effectiveness. Phosphate esters, and more preferably the alkali metal salts of these, are particularly preferred for use in the present invention in view of the fact that, compared to the organic sulphate and sulphonate surfactants, they give a greater level of flow improvement, they tend to give rise to less foam during mixing and do not themselves emit $SO_x$ compounds during casting.

The water-soluble surfactant may be used in the form of a solid or liquid of up to 100% activity or as an aqueous solution. The surfactant in any of these forms will typically be used in an amount of from about 0.01 to about 20% by weight and preferably from 0.05 to 5% by weight based on the weight of the aqueous binder. The concentration of surfactant when used as an aqueous solution may be from 0.1 to 99.9% by weight of the aqueous solution.

Preferably, in the forming step of the process the mixture is blown into a core box by a core blower.

Preferably in step (b) the binder comprises at least 0.25% by weight, and the particulate material comprises up to 99.75% by weight, of the total weight of the particulate material and the binder. More preferably in step (b) the binder comprises from 0.5 to 50% by weight, and the material comprises from 99.5 to 50% by weight, of the total weight of the particulate material and the binder. Yet more preferably the binder comprises from 0.5 to 10% by weight and the particulate material from 99.5 to 90% by weight, of the total weight of the particulate material and the binder.

When the particle size of the particulate material is relatively small, a relatively large amount of binder will be required in order to ensure that the binder matrix binds together the larger number of particles which provide a correspondingly large surface area.

According to an especially preferred embodiment, the mixture of water-insoluble particulate material, inorganic binder and water-soluble surfactant additionally contains at least one fine particulate material since it is our finding that such an addition results in an improvement in the strength and related properties of the mould, when hot, prior to casting. By "fine particulate material" we mean one which has a particle size not greater than 100 μm, and preferably less than 10 μm, with a surface area preferably greater than $50m^2g^{-1}$ which may be provided by a degree of porosity. The fine particulate material should be water insoluble and also heat stable to 700° C. According to one embodiment, the fine particulate material is produced synthetically by precipitation. The precipitation process results in primary particles in the range of from 10–60 nm which aggregate together to form a secondary particle of several μm in size.

Material thus produced has greater porosity and surface area than the natural material, and consequently the necessary addition level is lower than that of the natural material. The synthetic material may be three times the cost of the natural material, however the necessary addition level of the natural material may be ten times that of the synthetic material. It is thus cost effective to use the synthetic material. In another preferred embodiment of the invention the binder in (b) contains a molecular sieve material $Na_{86}[(AlO_2)_{86}(SiO_2)_{106}].XH_2O$ in powdered form. The particle diameter is less than 10 μm and the nominal pore size is about 1 nm.

The amount of fine particulate refractory material useful in the present invention to improve the hot strength properties of a mould or core depends on the ultimate strength required by the mould or core in a particular application. Typically, the fine particulate refractory material will be added in an amount which is not less than 0.02% by weight based on the total weight of the mould and core since lower amounts tend not to bring about any measurable improvement in hot strength properties. Since the fine particulate refractory material is preferably added as a slurry in an aqueous solution of the binder, e.g., glass solution, the maximum addition possible may be determined by maximum viscosity of the slurry that can be tolerated. For instance, for a sodium aluminosilicate slurry in sodium polyphosphate glass solution the viscosity increases substantially at additions of sodium aluminosilicate of between 10 and 15% by weight based on the weight of the glass solution. The maximum addition is, of course, also determined by the ultimate strength desired. Taking these effects into account, we believe that the maximum addition of fine particulate refractory material will typically be not greater than 1.0% by weight based on the total weight of the mould or core. Preferably, the addition will be in the range of from 0.2 to 0.8% and more preferably from 0.3 to 0.6% by weight based on the total weight of the mould or core.

Examples of fine particulate materials that can be used in the present invention include silica, calcium silicate, sodium aluminosilicate and powdered feldspar.

Without wishing to be bound by theory, it is believed that fine particulate silicas, silicates and aluminosilicates or other refractory materials are able to absorb the chemically bound water which is released from polyphosphate and borate binders during the dehydration cure step. With binders that contain polyphosphate chains in aqueous solution, phosphate hydrates are formed before and during the dehydration cure step. Once all of the free water is removed, some of the chemically bound water contained in the phosphate hydrate is released. This release of chemically bound water can partially redissolve the phosphate binder resulting in softening and distortion of the mould. Fine particulate silicas, silicate and aluminosilica or other refractory materials well dispersed into the binder, especially those with a high surface area, are able to absorb the released chemically bound water before it redissolves the phosphate binder.

It has been found where the amount of binder is relatively small as compared to the quantity of sand or other particulate material, it is preferable to introduce the water, the water-soluble glass and the water-soluble surfactant in the form of an aqueous solution. The glass in a powdered form is simply added to water and mixed with a high shear mixer to achieve full solution. The water-soluble surfactant may be added to the solution or may be incorporated into the refractory particulate material separately before or after the addition of the glass solution. Typically, a portion of solution containing the glass and the surfactant is added to the refractory particulate material and mixed thoroughly before further treatment e.g., blowing into a core box.

According to a preferred embodiment the mixture of particulate material, binder and surfactant is heated to a temperature in excess of 100° C. prior to being formed into the desired shape. The particulate material, e.g., foundry sand, may be heated prior to being mixed with the binder. This enables a supply of hot sand to be maintained in reserve so that the period for which the mixture of sand, binder, surfactant and water needs to be heated together may be reduced. If the sand is prior heated to a temperature of 100° C. or greater then when this is mixed with the other material the resultant mixture will have a temperature close to or even greater than 100° C. The binder may also be heated prior to mixing although care should be exercised to ensure that water is not excessively volatilised off from the binder composition.

After the mixture has been prepared and, if desired, heated, the mixture is formed into the desired shape. This may be achieved by blowing the optionally heated mixture into a suitable core box using a core blower. If a prior heated mixture is used the temperature of the mixture is preferably maintained during transfer to the core box.

After the mixture has been formed into the desired shape water is then removed from the mixture.

The removal of water from the core or mould can be carried out in a number of ways. In order to facilitate the drying process we prefer to purge the core or mould box containing the mixture with compressed air, preferably at an elevated temperature. We have found that the use of purging air at a temperature in the range of from 50° to 150° C. gives good results. The core or mould box will also, usually, be heated and in this respect we prefer to heat the core or mould box to a temperature in the range of from 80° to 105° C. In the case of a core, the initial treatment of the core while in the core box can reduce the time needed to complete removal of water when the core is removed from the box, in the case when removal of water in the core box is incomplete. A preferred route is to heat the core box and purge with compressed air for an appropriate period of time. For instance, the core box may be heated to a temperature of from 80° to 105° C. and then purged with compressed air at a pressure of 80 psi for 30 seconds to 1 minute. The core is then transferable without damage to an oven where final removal of free water can be accomplished by heating at a temperature in the range 120° C. to 150° C. Using an unheated core box and a compressed air purge typically having a pressure in the range 60–80 pounds per square inch, the air being at room temperature, a handleable core may be obtained after carrying out the purging for a period of from about 4 to 20 minutes. Compressed air at a temperature in the range 80° to 100° C. and a pressure of about 80 pounds per square inch can also be used, and in this case the core is transferable after about 1 minute. We have found that by heating the mixture in the core box at a temperature in excess of 100° C., for instance at 105° C., and purging with compressed air at a temperature of about 150° C. further benefits may be achieved. With such conditions, it is possible to reduce the compressed air purge time to as low as 10–15 seconds and to avoid the need for a final drying step in an oven. If a core box is made of a material which is substantially transparent to microwaves, e.g., an epoxy resin, the box containing a core may be transferred to a microwave oven and the core dried in about two minutes using a power of about 700 watts and the final drying step in an oven at 120° C. to 150° C. is not needed. Vacuum drying at a temperature of about 25° C. (room temperature) and a vacuum of 700 mm Hg (93.3 kPa) can also be used.

The removal of the core or mould after casting may simply be carried out by soaking the casting in a water bath and then flushing the casting with water. The use of water at high pressure in the case of a core encourages the dispersion of the core, especially when intricate cores of moulds are being used. The presence of a wetting agent in the water used to form the core may assist this dispersion. Alternatively, if the presence of a low concentration of alkali ions is tolerable, a small proportion of sodium carbonate in the core or mould mixture, preferably sodium carbonate decahydrate so that it does not absorb water, may assist the dispersion of the core especially if a dilute acid, such as citric acid is used to flush the core.

The following examples illustrate but do not limit the invention.

In the following examples, the flowability, the dog bone tensile strength and the dispersibility of cores were measured according to the following test methods.

Flowability of the moulding composition, i.e., the mixture of sand, binder, water, and other additives, was measured by the mouldability test given in the "AFS Mold and Core Test Handbook". According to this procedure 200 g of the moulding composition was placed in a George Fischer mouldability test apparatus equipped with an 8 mesh cylindrical screen. The mixture was riddled through the screen for 10 seconds. The Flowability index, %F, was calculated as the percentage of the mixture which passed through the screen.

The flowability of the sand mix made with 45% solution of a sodium polyphosphate glass of composition $P_2O_5$ 62.5%, $Na_2O$ 36.5% (Binder I) had an average value of 59.8% with a range over five measurements of 56–63%. This sand/binder mix was used to blow cores in the shape of dog bone tensile test pieces of nominal cross-sectional area 1 square inch and cured by purging with air at 150° C. for 60 seconds. The tensile strength, P/O T.S., of six bones was measured after allowing them to cool to room temperature. The average tensile strength was 153 psi with a range of 140 to 160 psi.

The bone halves were heated in an oven at 500° C. for 1800 seconds and allowed to cool to room temperature. The dispersibility was then measured by placing the pieces on a wire mesh suspended in stirring water maintained at a temperature of 50° C. Dispersibility, D, was measured as the time taken for the test pieces to soften and fall through the mesh. The value of D was measured as 60s.

EXAMPLE 1

Chelford 60 sand was mixed with a 45% by weight solution of a sodium polyphosphate glass of composition $P_2O_5$ 62.5%, $Na_2O$ 36.5% (Binder I) containing an additional 9 parts by weight of an aluminosilicate powder (ASP). The aim was to examine the effect of the further addition of small amounts of water as a comparative test for the addition of similar amounts of surfactant solution. Table I shows the flowability data for a range of mixes.

TABLE I

FLOWABILITY INDEX FOR SAND COATED WITH 45% BINDER I/9 PARTS ASP AND VARIOUS ADDITIONS OF WATER (EXPRESSED AS PARTS PER HUNDRED PARTS BINDER I SOLUTION)

| Addition Level of Water to Binder | % F |
|---|---|
| 0.1 | 62 |
| 0.2 | 58 |
| 0.5 | 63 |
| 1.0 | 56 |

TABLE I-continued

FLOWABILITY INDEX FOR SAND COATED WITH 45% BINDER I/9 PARTS ASP AND VARIOUS ADDITIONS OF WATER (EXPRESSED AS PARTS PER HUNDRED PARTS BINDER I SOLUTION)

| Addition Level of Water to Binder | % F |
|---|---|
| 2.0 | 58 |
| 2.5 | 56 |

The data of Table I show that small additions of water to the binder had no effect on the sand mix flowability.

EXAMPLE 2

Chelford 60 sand was mixed with a 45% by weight solution of Binder I containing an additional 9 parts by weight ASP and an additional level of a 20% w/v solution of an alcohol sulphate surfactant, sodium lauryl sulphate, SLS. (Fisons Limited, Loughborough, UK). The binder addition to sand was 4% by weight. Table II shows the flowability data.

TABLE II

FLOWABILITY INDEX FOR SAND COATED WITH 45% BINDER I/9 PARTS ASP AND VARIOUS ADDITIONS OF 20% SLS (EXPRESSED AS PARTS PER HUNDRED PARTS BINDER I SOLUTION)

| Addition Level of Surfactant to Binder | % F |
|---|---|
| 0.1 | 53.5 |
| 0.2 | 55 |
| 0.5 | 62.5 |
| 1.0 | 67 |
| 2.5 | 76.5 |
| 3.0 | 71.5 |
| 3.5 | 68 |

The data of Table II show the effectiveness of an alcohol sulphate surfactant as a flow promoter of this invention. The optimum level of SLS was 2.5 parts per 100 parts Binder, I solution since this gave the maximum flow. Beneficially, this flow was of the order of an additional 20% on the %F value generated when an identical quantity of water was added to the binder, all other things being equal.

The sand mix made with binder containing 2.5 parts SLS was blown into dog bones. The average tensile strength was 125 psi with a range of 110–140 psi, showing a slight reduction in strength when SLS is used to improve flow.

A disadvantage of SLS was its ability to produce foam during mixing of the binder. However, to overcome the problem of foam, the surfactant and binder may be added separately to sand. The dispersibility of cores measured as described above was 15 seconds.

EXAMPLE 3

The methods and materials of Example 2 were repeated but using a 20% w/v solution of a phosphate ester surfactant (phosphated 2-ethyl hexanol, potassium salt, PA 800K, Lakeland Laboratories Limited, Manchester, UK). The binder addition to sand was 4% by weight. Table III shows the flowability data.

TABLE III

FLOWABILITY INDEX FOR SAND COATED WITH 45% BINDER I/9 PARTS ASP AND VARIOUS ADDITIONS OF 20% PA 800K (EXPRESSED AS PARTS PER HUNDRED PARTS BINDER I SOLUTION)

| Addition Level of Surfactant to Binder | % F |
|---|---|
| 0.1 | 77 |
| 0.2 | 79 |
| 0.5 | 86 |
| 1.0 | 82.5 |
| 2.5 | 84.5 |
| 3.5 | 87.5 |

The data of Table III show the effectiveness of a phosphate ester surfactant as a flow promoter of this invention. An addition level of 0.5 parts per hundred parts Binder I gave a flow of 86% with no tendency of the binder to foam during mixing.

The sand mix made with binder containing 0.5 parts PA 800K was blown into dog bones. The average P/O tensile strength was 171 psi with a range of 155–180 psi. The improvement in both flowability and strength in this Example illustrates the general improvement in properties, in line with the discussion above, which might be expected when the flow is maximised with a phosphate ester surfactant. The dispersibility of heat treated cores was 35 seconds.

EXAMPLE 4

The methods and materials of Examples 2 and 3 were repeated but using a 20% w/v solution of an alkylaryl sulphonate surfactant (sodium alkylnaphthalene sulphonate, Rhodacal BX-78, Rhone Poulenc Chemicals, Stockport, UK) . The binder addition to sand was 4% by weight. Table IV shows the flowability data.

TABLE IV

FLOWABILITY INDEX FOR SAND COATED WITH 45% BINDER I/9 PARTS ASP AND VARIOUS ADDITIONS OF 20% BX-78 (EXPRESSED AS PARTS PER HUNDRED PARTS BINDER I SOLUTION)

| Addition Level of surfactant to binder | % F |
|---|---|
| 0.1 | 75 |
| 0.2 | 68 |
| 0.5 | 66 |
| 1.0 | 65 |
| 2.5 | 67.5 |

The data of Table IV show the effectiveness of an alkylarylsulphonate surfactant as a flow promoter of this invention. An addition level as low as 0.1 parts per hundred Binder I gave a flow of 75%. The binder had a slight tendency to foam during mixing.

The sand mix made with binder containing 0.1 parts BX-78 was blown into dog bones. The average tensile strength was 152 psi with a range of 140–160 psi. The dispersibility was 25 seconds.

A large range of water soluble surfactant materials might be considered for this invention. Many offer advantages with regard to the mix flowability yet which are detrimental to the CORDIS binder system in some other way.

Thus in one example an anionic surfactant widely used in many detergent applications, sodium dodecyl benzene sulfonate, was found to give a sand mix flow of 71% when added at a level of 2 parts of a 20% aqueous solution to the Binder I/ASP material of Examples 2, 3 and 4. The surfactant produced a stable foam during the preparation of the binder which may lead to problems in the accurate metering of binder to sand. However, to overcome the problem of foam, the surfactant and binder may be added separately to sand.

Other surfactants of non-ionic character or as blends incorporating one or more non-ionic surfactants were also examined. Thus in one example a polyethylene-polypropylene oxide copolymer non-ionic surfactant (Synperonic PE/F88, ICI Surfactants, Middlesbrough, UK) added to a 45% aqueous solution of Binder I containing an additional 9 parts ASP at a level of 20 parts of a 2% aqueous solution gave a sand mix flow of 71%. Dog bone cores made with this sand mix had a P/O strength of just 53 psi, however, which compared to a control strength of 153 psi is unacceptable.

In another example a surfactant blend of anionic and non-ionic character (Disperse-Ayd W22, Daniel Products Co., New Jersey, USA) was added to a 45% aqueous solution of Binder I containing an additional 9 parts ASP at a level of 3 parts of a 3% aqueous solution. The sand mix flow was 79% but cores made with this mix had a P/O strength of just 86 psi, which compared to a control strength of 153 psi is unacceptable.

Silicone emulsions are well known in the foundry industry as flow promoters for sand mixes which incorporate traditional organic resins. A silicone emulsion (Silicone M404, ICI Speciality Chemicals, Kortenberg, Belgium) was added to a 45% aqueous solution of Binder I containing an additional 9 parts ASP. The silicone emulsion was added at a level of 2 parts of the 35% emulsion. The sand mix flow was 70%. Dog bone cores made with this mix had an average P/O tensile strength of 142 psi.

However, the negative aspect of silicone emulsions in this embodiment is their marked ability to prevent the ingress of water to cores. Thus in the above example, cores heat treated as described in Example 1 had a dispersibility of 1200 seconds.

Other surfactants of cationic character were also examined. Thus in one example a quaternary ammonium compound, benzalkonium chloride (Sigma Chemical Company Limited, Poole, UK) was added to a 45% Binder I solution with an additional 9 parts ASP at a level ranging from 0.09 to 0.9 parts of a 5% aqueous solution. All addition levels of this surfactant resulted in a thick gel in the binder material. The formation of a gel would lead to severe problems in the conveying and accurate metering of binder to sand. Sand mix flows measured using this surfactant in the binder were 50–55%, which is no improvement compared to the control.

In another example an amphoteric surfactant, N-N dicarboxylethylalkylamine, sodium salt AMA LF40, (Lakeland Laboratories Limited, Manchester, UK), was examined. The addition level of surfactant was 2 parts of a 20% aqueous solution to a 45% aqueous solution of Binder I with an additional 9 parts ASP. The flowability index measured was 57%. The same addition level of this surfactant at a solution concentration of 10% gave a flowability index of 59%. These data indicate that this amphoteric surfactant did not improve the flowability of the sand/binder mix as they were similar to those obtained when just water was added at the same level.

EXAMPLE 5

The following Examples illustrate how surfactants which may be used in the present invention work to varying degrees of effectiveness.

The methods and materials of Examples 2, 3 and 4 were repeated but using a 40% w/v solution of a sodium 2-ethylhexyl sulphate surfactant (Niaproof NAS 08, Niacet Corp., New York, USA) added at an addition level of 2% by weight of the aqueous binder. The %F was 64% showing a small improvement in flow over the control value.

The methods and materials of Examples 2, 3 and 4 were repeated but using a 20% w/v solution of a phosphate ester surfactant (an ethoxylated nonyl phosphate ester in acid form, Stepfac PN209, Stepan Europe, Voreppe, France) added at an addition level of 2.5% by weight of the aqueous binder. The %F was 65% showing a small improvement in flow over the control value.

Example 6

Some further experiments were carried out:

1) To evaluate blowability of sand mixtures containing binder solutions only.

2) To examine the effect of incorporating various surface active agents into the binder formulation upon blowability of the mixture.

3) To examine the effect of change of concentration of the additive upon blowability of the mixture.

4) To determine how choice of sand influences blowability with these binder/surfactant mixtures.

EXPERIMENTAL

1) Binder Solution Preparation a) Water (55 parts by weight) was charged to a mixing vessel and agitated using a high shear mixer. A water soluble glass powder having a composition comprising $Na_2O$ 30%, $P_2O_5$ 69.5% and moisture 0.5% (45 parts by weight) was added portion wise. The rate of addition was controlled to ensure complete solution.

b) Where additives were solids or liquids with 100% active content, appropriate quantities were added to give predetermined concentrations.

c) Where surface active agents were provided as aqueous solutions, the water input to the base solution of the soluble glass was adjusted so that additions were equivalent to 100% active.

Not all of the substances added to the base binder were soluble at all concentrations. Where this was the case, mixtures were agitated thoroughly to obtain a suspension or emulsion prior to addition to the sand of choice.

2) Preparation of Sand and Binder Mixtures a) Choice of Sand

All binder/surfactant combinations were applied to Chelford 60 AFS.

Selected combinations were examined with Frechan 33 and LA32 sands.

b) Mixture Preparation

Sand (25 parts by weight) was charged to the mixing vessel of a Kenwood K blade mixer. The binder combination of choice (1 part by weight) was added and the whole mixed to an even consistency.

3) Blowability Determination

The sand/binder mixture (1.0 kg) was charged to the blowing cartridge of the blowability test equipment (FIG. 1). A meshed blank piece was screwed onto the end of the blow tube and the cartridge was placed through the lid into the containers. The mixture was compacted by applying air pressure (50 p.s.i) for one second from a modified Ronceray bench top core blower.

This procedure was repeated after removal of the meshed blank piece. Sand and binder mixture was blown from the cartridge and collected in the pre-weighed inner container. By determining the amount of material collected in the inner container a measure of blowability could be calculated. Results were determined as an average of three blows with the same mixture.

4) Repeatability Tests

Tests were conducted to allow an examination of the reproducibility of the blow test method.

A freshly prepared solution of binder (55 parts water, 45 parts of a soluble glass comprising $Na_2O$ 30%, $P_2O_5$ 69.5% and moisture 0.5%, 0.1 parts 2-Ethylhexylphosphate (Potassium Salt)) was added at a ratio of 1 part to 25 parts Chelford AFS 60 sand with thorough mixing. The blowability of the mixture was determined as described previously. This procedure was repeated using six individually prepared mixtures (Table 1A).

RESULTS

The blowability data obtained using a 4% loading of the binder solution without surfactant indicates that there is not significant difference upon changing the sand type (Table 1).

Anionic surfactants were studied for their effect upon blowability with varying concentration. These results are recorded for Chelford 60 AFS sand (Table 2).

Results obtained when cationic additives were introduced into the binder were determined using Chelford 60 AFS sand (Table 3).

The quaternary ammonium chloride appeared to give the best results obtained from the cationic surfactant tested. It too was largely soluble in the binder solution whereas the primary and secondary amines were only usable as emulsions.

Of the nonionic surfactant examined again virtually all were found to have a positive influence on blowability. Except in the case of the alkylolamide, increasing concentration of the surfactant appeared to give corresponding improvements in blowability.

The alkylbetaine (amphoteric) surfactant appears as the most impressive of the blowability enhancing materials examined in this work.

TABLE 1

| Sand Type | Average Blowability (%) |
|---|---|
| Chelford 60 | 30.9 |
| Frechan 33 | 29.6 |
| Bervialle | 29.0 |

Binder addition - 4% w/w w.r.t. sand

TABLE 1A

| Mix | Average Blowability |
|---|---|
| 1 | 33.5% |
| 2 | 42.8% |
| 3 | 38.9% |
| 4 | 37.7% |
| 5 | 36.0% |
| 6 | 38.2% |

TABLE 2

Blowability Effects with Varying Concentration of Anionic Surfactant
Chelford 60 A.F.S. with 4% binder

| Surfactant | | Blowability at Surfactant Concentration | | | | | | | |
|---|---|---|---|---|---|---|---|---|---|
| Name | Type | 0.01% | 0.05% | 0.1% | 0.5% | 1.0% | 5.0% | 10.0% | 25.0% |
| Sodium Lauryl Sulphate | Alkylsulphate | 41.7 | 42.7 | 42.1 | 40.5 | 44.3 | 44.5 | 45.5 | 53.7 |
| Sodium Toluene Sulphate | Aryl Sulphate | 42.5 | 44.0 | 43.5 | 43.4 | 35.3 | 36.5 | 37.1 | 37.4 |
| Sodium Alkyl Phenol Ether Sulphonate | Ether Sulphate | 32.7 | 33.8 | 55.0 | 37.7 | 44.1 | 39 | 41.8 | 36.7 |
| Sodium Dodecyl Benzene Sulphonate | Alkyl/Aryl Sulphonate | 34.2 | 35.0 | 45.2 | 57.8 | 46.0 | 47.8 | — | — |
| 2-Ethylhexyl Posphate Potassium Salt | Phosphate Ester | 44.5 | 45.3 | 44.6 | 46.9 | 45.8 | 52.3 | 47.5 | 51.3 |
| Perfluoro Alkyl Sulphate | Fluorosurfactant | 45.7 | 47.5 | 48.9 | 51.2 | 47.2 | 54.5 | 56.4 | 53.7 |
| Fatty Alcohol Sulphonsuccinate | Sulphosuccinate | 36.7 | 39.3 | 35.7 | 36.2 | 37.8 | 48.8 | 42.6 | 48.5 |
| Sodium —N— Methyl —N— Cocoyl Taurate | Taurate | 39.9 | 46.1 | 35.0 | 38.9 | 35.7 | 38.4 | 46.3 | 44.8 |
| Oleyl Sarcosinate Acid Form | Sarcosinate | 33.3 | 38.9 | 42.5 | 56.1 | 41.9 | 49.3 | 44.4 | 33.3 |

TABLE 3

Blowability Effects with Varying Concentration of Cationic Surfactants

| Surfactant | | Blowability at Surfactant Concentration | | | | | | | |
|---|---|---|---|---|---|---|---|---|---|
| Name | Type | 0.01% | 0.05% | 0.1% | 0.5% | 1.0% | 5.0% | 10.0% | 25.0% |
| Dodecylamine | Primary Amine | 36.2 | 38.4 | 40.0 | 41.1 | 44.6 | 46.8 | 35.1 | 35.9 |
| Dicocoamine | Secondary Amine | 31.7 | 35.4 | 36.1 | 37.1 | 43.0 | 32.7 | 39.2 | — |
| Dicocodimethyl Ammonium Chloride | Quaternary Ammonium Chloride | 41.5 | 41.9 | 40.3 | 48.8 | 48.9 | 49.9 | 60.8 | 49.6 |

TABLE 4

Blowability Effects with Varying Concentration of Non-Ionic Surfactants

| Surfactant | | Blowability at Surfactant Concentration | | | | | | | |
|---|---|---|---|---|---|---|---|---|---|
| Name | Type | 0.01% | 0.05% | 0.1% | 0.5% | 1.0% | 5.0% | 10.0% | 25.0% |
| Ethylene oxide/ Propylene oxide Block Polymer | OH value 27–24; | 36.8 | 35.9 | 37.2 | 54.9 | 52.0 | 50.1 | 50.8 | 31.9 |
| EO/PO Block polymer | OH value 11.8–7.8 | 39.0 | 45.9 | 44.2 | 50.1 | 59.8 | 56.7 | 59.4 | 47.8 |
| EO/PO Block Polymer | 25.4–21.5 | 34.0 | 32.9 | 32.6 | 45.7 | 57.1 | 53.2 | 51.4 | — |
| Polyoxythylene Sorbitan Monolaurate | Ester | 43.0 | 40.3 | 44.0 | 46.4 | 48.5 | 51.2 | 53.8 | 59.2 |
| Polyoxythylene Sorbitan Monoleate | Ester | 38.1 | 40.5 | 43.0 | 47.9 | 56.7 | 43.9 | 51.8 | — |
| Lauric Acid Diethanolamide (2:1) | Alkylolamide | — | 42.5 | 45.7 | 40.0 | 42.2 | 39.4 | 42.7 | 43.7 |

TABLE 5

Blowability Effects with Varying Concentration of Amphoteric Surfactant

| Surfactant | | Blowability at Surfactant Concentration | | | | | | | |
|---|---|---|---|---|---|---|---|---|---|
| Name | Type | 0.01% | 0.05% | 0.1% | 0.5% | 1.0% | 5.0% | 10.0% | 25.0% |
| Dodecyl/Tetradecyl Betaine Mixture | Alkyl Betaine | 47.5 | 52.7 | 72.0 | 57.5 | 64.8 | — | — | — |
| Coconut Imidazoline Betaine | Alkyl Imidazoline | 32.3 | 36.6 | 33.7 | 35.7 | 37.1 | 68.4 | — | — |

TABLE 6

Evaluation of LA32 and Frechan 33 sands with Selected Surfactants

| | | Blowability at Surfactant Concentration | | | | | | | |
|---|---|---|---|---|---|---|---|---|---|
| Sand Type | Surfactant | 0.01% | 0.05% | 0.1% | 0.5% | 1.0% | 5.0% | 10.0% | 25.0% |
| Sable LA32 | EO/PO Block Polymer | 36.4 | 37.1 | 45.0 | 51.0 | 56.0 | 54.8 | 62.5 | 35.0 |
| Sable LA32 | Sodium Lauryl Sulphate | 36.8 | 42.5 | 41.9 | 49.3 | 53.9 | 44.6 | 39.4 | 59.5 |
| Sable LA32 | Phosphate ester Potassium Salt | 40.8 | 43.1 | 36.1 | 44.9 | 54.1 | 54.4 | 60.2 | 65.4 |
| Sable LA32 | Polyoxethylene Sorbitan Monolaurate | 40.4 | 43.1 | 39.0 | 47.1 | 47.9 | 52.5 | 53.8 | — |
| Frechan 33 | Sodium Alkyl Phenol Ether Sulphate | 32.8 | 33.3 | 36.4 | 41.5 | 46.1 | 51.2 | 49.6 | 53.7 |

LABÆTR88P

The tertiary amines examined did not dissolve or disperse adequately in the binder solution and hence blowability studies were not performed.

Acetate salts of the amines were prepared and examined to determine if these had improved solubility in the base binder solution. Only in the case of the tertiary amine salt (hexadecyl dimethylamine acetate) was enhanced solubility observed. However, despite dissolution of the amine acetate in the binder, a very viscous gel like liquid was obtained. This was not readily mixed with sand.

Nonionic surfactant with binder on Chelford 60 AFS were examined for flow enhancement properties. (Table 4).

The blowability of mixtures containing amphoteric type surfactants was also examined. Alkyl betaine and alkyl imidazoline betaine data is show in Table 5.

Where sand types other than Chelford 60 AFS were available, these were evaluated for blowability with binder/surfactant mixtures. (Table 6)

CONCLUSIONS

Many of the surfactant substances have been shown to have some positive influence upon flow improvement in blowability evaluations.

In some cases the improvements in flowability show very little further increase with increasing concentration. Further it should be noted that at high surfactant concentrations there is a relative decrease in the quantity of binder (as soluble glass) present in the mixture.

The nature of the blowability test does not lend itself to the generation of "absolute data" but rather indicates trends as variables are adjusted.

Of the ionic surfactants, 2-ethylhexyl phosphate (potassium salt), sodium lauryl sulphate and the perfluoroalkyl sulphonate gave rise to significant increases in blowability at low initial concentration and this was sustained at higher levels. The first two appeared to be completely soluble in the binder solution especially at the lower concentrations.

I claim:

1. A binder composition for binding a water-insoluble particulate material in the manufacture of a foundry mold or core which comprises a mixture of (1) an inorganic binder consisting of an aqueous solution containing at least one matrix former selected from the group consisting of polyphosphate chains derived from a water-soluble phosphate glass and borate ions and (2) a water-soluble surfactant in an amount of from 0.01 to 20% by weight of the inorganic binder.

2. A composition according to claim 1, where the borate ions are derived from a borate glass.

3. A composition according to claim 1, wherein the matrix former consists of polyphosphate chains derived from a water-soluble phosphate glass containing from 30–80 mol %, $P_2O_5$, from 20–70 mol % $X_2O$, from 0–30 mol % MO and from 0–15 mol % $L_2O_3$, where X is Na, K or Li; M is Ca, Mg or Zn and L is Al, Fe or B.

4. A composition according to claim 1, wherein the water soluble surfactant comprises at least one anionic, nonionic, cationic or amphoteric surfactant.

5. A composition according to claim 4, wherein the water-soluble surfactant is an anionic surfactant selected from the group consisting of organic sulphates, organic sulphonates and organic phosphate esters.

6. A composition according to claim 5, wherein the water-soluble surfactant is an alkali metal salt of an organic mono- or di-ester of orthophosphoric acid or mixtures of these esters.

7. A water-dispersible core or mold for making a casting, the core or mold comprising a water-insoluble particulate material, an inorganic binder therefor and a water-soluble surfactant, wherein the inorganic binder consists of at least one matrix former selected from the group consisting of polyphosphate chains derived from a water-soluble phosphate glass and borate ions.

8. A water-dispersible core or mold according to claim 7 which additionally contains a second particulate refractory material wherein the second particulate refractory material has a particle size not greater than 100 μm.

9. A water-dispersible core or mold according to claim 8, wherein the second particulate refractory material is selected from the group consisting of powdered aluminosilicate, powdered calcium silicate and powdered feldspar.

10. A water-dispersible core or mold according to claim 7, wherein the water-insoluble particulate material is foundry sand.

11. A water-dispersible core or mold according to claim 7, wherein the water-soluble surfactant comprises at least one anionic, nonionic, cationic or amphoteric surfactant.

12. A water-dispersible core or mold according to claim 11, wherein the water-soluble surfactant is an anionic surfactant selected from the group consisting of organic sulphates, organic sulphonates and alkali metal salts of organic mono- or di-esters of orthophosphoric acid and mixtures of these esters.

13. A process for making a water-dispersible core or mold for making a casting which process includes the steps of:

(a) combining a water insoluble particulate material with a binder composition comprising a mixture of (1) an inorganic binder consisting of an aqueous solution of at least one matrix former selected from the group consisting of polyphosphate chains derived from a water-soluble phosphate glass and borate ions and (2) a water-soluble surfactant in an amount of 0.01 to 20% by weight of the aqueous solution of the inorganic binder to form a mixture of water-insoluble particulate materials and binder composition, (b) forming the mixture of water-insoluble particulate material and binder composition into a shape; and (c) removing free water from the mixture.

14. A process according to claim 1, wherein in step (b) the mixture is blown under pressure into a core or mold box thereby to shape the mixture into a shape.

15. A process according to claim 14, wherein the core or mold box is heated before the mixture is blown therein.

16. A process according to claim 14, wherein the mixture is blown by means of compressed air.

17. A process according to claim 14, wherein after the mixture has been blown into the core or mold box, the core or mold box filled with the mixture is purged with compressed purging air.

18. A process according to claim 17, wherein the compressed purging air is at an elevated temperature.

19. A process according to claim 18, wherein the elevated temperature is from 50° to 150° C.

20. A process according to claim 17, wherein the compressed purging air removes the free, non chemically bound, water from the mixture.

21. A process according to claim 14, wherein in step (c) water is removed from the mixture by heating.

22. A process according to claim 21, wherein the mixture is heated to a temperature in excess of 100° C. to accelerate removal of non-chemically bound water from the mixture during purging.

23. A process according to claim 21, wherein the mixture is heated in a hot air oven after removal from the core or mould box.

24. A process according to claim 21, wherein the core or mold box is substantially transparent to microwaves and the mixture is heated in the core or mold box.

25. A process according to claim 1, wherein the water-insoluble particulate material is foundry sand.

26. A method of improving the flowability of a water-insoluble particulate material and an inorganic binder consisting of an aqueous solution containing at least one matrix former selected from the group consisting of polyphosphate chains derived from a water-soluble phosphate glass and borate ions which comprises incorporating in the mixture a water-soluble surfactant in an mount of from 0.01 to 20% by weight based on the weight of the inorganic binder.

27. A method according to claim 26, wherein the water-soluble surfactant comprises at least one anionic, nonionic, cationic or amphoteric surfactant.

28. A method according to claim 27, wherein the water-soluble surfactant is an anionic surfactant selected from the group consisting of organic sulphates, organic sulphonates and organic phosphate esters.

29. A method according to claim 28, wherein the water-soluble surfactant is an alkali metal salt of an organic mono- or di-ester of orthophosphoric acid or mixtures of these esters.

* * * * *